US005379050A

United States Patent [19]

Annis et al.

[11] Patent Number: 5,379,050

[45] Date of Patent: Jan. 3, 1995

[54] METHOD OF DRIVING A MATRIX DISPLAY DEVICE AND A MATRIX DISPLAY DEVICE OPERABLE BY SUCH A METHOD

[75] Inventors: Alexander D. Annis, Haywards Heath; Alan G. Knapp, Crawley; Jeremy N. Sandoe, Horsham, all of Great Britain; Peter B. A. Wolfs, Eindhoven, Netherlands

[73] Assignee: U.S. Philips Corporation, New York, N.Y.

[21] Appl. No.: 797,887

[22] Filed: Nov. 26, 1991

[30] Foreign Application Priority Data

Dec. 5, 1990 [GB] United Kingdom ..... 9026494
Nov. 6, 1991 [GB] United Kingdom ..... 9123561

[51] Int. Cl.[6] ..... G09G 3/36

[52] U.S. Cl. ..... 345/94; 345/58; 345/91

[58] Field of Search ..... 340/784, 784 D, 805, 340/765, 811; 359/54, 55, 57; 358/241; 345/91, 94, 87, 90, 96, 97, 99, 100, 58

[56] References Cited

U.S. PATENT DOCUMENTS 4,649,383 3/1987 Takeda et al. ..... 340/805
4,845,482 7/1989 Howard et al. ..... 340/805
4,892,389 1/1990 Kuijk ..... 359/55
4,990,905 2/1991 Kuijk ..... 340/805

*Primary Examiner*—Ulysses Weldon
*Assistant Examiner*—Doon Chow
*Attorney, Agent, or Firm*—Robert J. Kraus

[57] ABSTRACT

In operation of an active matrix display device comprising an array of display elements (12), for example liquid crystal elements, each connected in series with an associated two terminal non-linear switching device (30), e.g. a MIM, between row and column address conductors (22,24), and row and column driver circuits (40,43) for applying selection signals to each row conductor in turn and data signals to the column conductors, the data signals are applied for part only of the row address period and a row selection signal commences prior to the data signal and while a reference potential is applied to the column conductors whereby during a row address period a display element is initially charged to a level approaching the lower end of the display element's operational range of voltages and thereafter charged to the required level according to the data signal. Vertical cross-talk is reduced and peak current density through the non-linear devices is kept low, thereby avoiding the risk of damage.

15 Claims, 7 Drawing Sheets

METHOD OF DRIVING A MATRIX DISPLAY DEVICE AND A MATRIX DISPLAY DEVICE OPERABLE BY SUCH A METHOD

BACKGROUND OF THE INVENTION

The present invention relates to a method of driving a matrix display device comprising an electro-optical display medium between two supporting plates, an array of display elements arranged in rows and columns with each display element being constituted by electrodes provided on the facing surfaces of the supporting plates, and sets of row and column conductors, each display element being connected in series with a two-terminal non-linear switching device between associated row and column conductors, in which each row of display elements is selected during a row address period by a selection signal of a row signal waveform applied to the row conductors and data signals are applied via the column conductors for a part of the address period by means of which selection and data signals a range of operational voltages can be produced at the display elements for display purposes, a reference potential being applied to the column conductors during the remainder of the address period.

The invention also relates to a matrix display device which can be operated using such a method.

An active matrix display device of the above type is suitable for displaying video, for example, TV, pictures using passive electro-optical display media such as liquid crystal material, electrophoretic suspensions and electrochromic materials, although it can be used to display alphanumerical information instead.

A conventional drive scheme for liquid crystal display devices using two terminal non-linear switching devices involves applying a selection voltage to a row conductor during a selection period, corresponding in the case of TV display to a maximum of a TV line period, causing the switching devices associated with that row conductor to operate in the charging region of their characteristic so that the capacitances of the display elements concerned rapidly charge to a display voltage according to a data signal voltage present on the column conductor at that time. The display voltage produced lies in a predetermined operational voltage range used for picture display which in the case of a liquid crystal display device has lower and upper limits in the range of transition in the transmission/voltage characteristic of the liquid crystal material, commonly referred to as the threshold and saturation voltages respectively, at which the display element exhibits substantially maximum and minimum transmission, or vice versea depending on the relative orientation of associated polarising layers on the two supporting plates. At the end of the selection period the row conductor voltage falls to a lower, hold, value selected so that the mean voltage across the switching device during the period until it is next addressed, is minimised. Assuming an ideal situation, this hold voltage is equal to the mean of the rms saturation and threshold voltages of the display element.

In a known drive scheme, described in U.S. Pat. No. 4,892,389, the display element addressing period is shortened in order to reduce vertical cross-talk caused by the capacitance of the switching devices which can result in display element voltages varying over a field period due to data signal voltages intended for other display elements. This can be achieved by reducing the length of time for which data voltage is present on the column conductors to a fraction of the available line period, determined by the video signal. During the remainder of the line period, the column voltage is returned to a constant reference voltage level. At the same time the row selection period is reduced so that it is no greater than the duration of the data signal.

However, a problem can arise with such a drive scheme particularly, but not exclusively, where the switching devices comprise MIMs. The reduction in the row selection period means that the same display element capacitance must be charged in a shorter time which, in turn, means that a larger selection voltage must be used. This results in an increase in the peak current density in the switching device which can, if large enough, lead to damage or even destruction of the switching device.

SUMMARY OF THE INVENTION

It is an object of the present invention to provide an improved method of driving a matrix display device, and a matrix display device capable of operating by this method, in which the effects of cross-talk are lessened while avoiding, at least to some extent, the risk of the switching devices being damaged.

According to one aspect of the present invention, a method of driving a matrix display device as described in the opening paragraph is characterised in that for a row of display elements the row selection signal commences prior to the application of the data signals and during the application of the reference potential whereby the display elements are initially charged to a level approaching the lower end of the operational range of voltages and thereafter are charged to the required level according to the applied data signals. When addressed, therefore, the display elements of a row are charged to a preliminary level, preferably close to, but below, the lower end of the operational range, during a first portion of the row address, selection, period and then the charge on the display elements is modified in a subsequent portion of the address period by in effect adding the data (video) signal so as to produce the required display effect, e.g. grey scale, in accordance with the level of the data signal. This method offers significant benefits. As in the known drive scheme for improving cross-talk performance the data signals are applied for only a part of the address period available for row selection and are of shorter duration than conventionally-used data signals so that a reduction in vertical cross-talk can be achieved. In addition, however, the pre-charging of the display elements prior to the application of the data signal means that the peak current density through a non-linear switching device is maintained at a comparatively low level. Consequently the risk of damage being caused to the non-linear devices through large peak current densities is removed and a greater freedom on the choice of the dimensions of the display elements is permitted since the constraints on the physical characteristics of the non-linear devices are relaxed. The latter benefit is especially important for display devices using MIMs as the non-linear switching devices. However, the method is applicable to display devices employing other types of two terminal non-linear switching devices known in the art, for example diode rings, back-to-back diodes, or pip or nin diode structures.

Preferably, the level to which a display element is initially charged approaches the lower end of the range of transition in the transmission/voltage characteristic of the electro-optical display medium, which for example, corresponds to the threshold voltage in the case of a liquid crystal display element.

It is customary for display devices using liquid crystal material to reverse periodically the voltage applied to the display elements so as to prevent a net DC voltage appearing across the material which can lead to degradation of the material. To this end the polarity of the voltage applied across the display element is inverted at given intervals, usually after each line (line inversion), after every two lines (double line inversion, or every field (field inversion).

The row signal waveform may be of a known kind comprising a succession of said selection signals separated by hold signal portions whose polarity is periodically inverted, making a four level waveform.

The row signal waveform may be of known kind comprising a succession of said selection signals separated by hold signal portions whose polarity is periodically inverted, making a four level waveform. In an embodiment of the invention the reference potential is then preferably periodically switched between two predetermined levels in accordance with the periodic inversion of the selection and data signals. For line inversion, double line inversion and field inversion drive schemes the reference level changes every line, every two lines and every field respectively. The two predetermined reference levels correspond to the absolute value of the data signal which produces the smallest operating voltage across the display element, that is, a voltage across a display element substantially corresponding to the level required for the lower end of the operating or transition range. For a display device using twisted nematic liquid crystal material with polarisers and operating in transmissive mode, this value of the data signal produces peak white, i.e. maximum transmission, in the case of the polarisers being crossed and black, i.e. maximum absorption, in the case of parallel polarisers. The switching of the reference potential level in this manner overcomes problems which might possibly be experienced when a single reference potential level is utilised due to the display elements precharging towards the level of this single reference potential.

Preferably also, the rising edge of selection signal is at least substantially complete before the voltage on the column conductor changes from the reference potential to the data signal. The rise of the selection signal thus starts a certain, short, time before the transition on the column conductor. During this precharging period the display element is charged towards the lowest end of its operating voltage range. Most usefully, the precharging period is chosen to lie in the range whose minimum is approximately equal to the rise time of the row selection signal and whose maximum is substantially equal to the the duration of the data signal on the column conductor.

The invention is applicable also to a drive scheme of the kind described in EP-A-0362939 in which the row signal waveform comprises five levels and includes a reset signal for the purpose of correcting non-uniformities in the behaviour of the two terminal switching elements across the array. Therefore, another embodiment of the invention using such a drive scheme is characterised in that the row signal waveform applied to each row conductor further includes a second selection signal comprising a reset signal portion by means of which the display elements of the row are charged at least to the upper end of the range of operational voltages followed by a setting signal portion by means of which the display elements are set at a level in the range of operational voltages according to the applied data signals, and in that for a row of display elements the setting signal portion commences prior to the application of the data signals and during the application of a reference potential whereby the display elements are charged from the level obtained by the reset signal portion back to a level close to the upper end of the range of operational voltages. This leads to a reduction in the current flowing in the switching devices during two of the three comparatively large transitions involved in such a five level row signal waveform which might otherwise result in damage. The reference potentials for use with the first mentioned selection signal and the setting signal portion may conveniently be applied to each column conductor in respective intervals between successive data signals applied to the column conductor. In order to reduce the possibility of damage occuring in all three transitions, then preferably the reset signal portion commences prior to the application of the data signals to the column conductors intended for a preceding row of display elements and during the application of a further reference potential to the column conductors whereby the display elements of the row are charged to a level approaching the lower end of the range of operational voltage and thereafter are charged to a least the upper end of the said range. In this case the reference potentials for use with the first-mentioned selection signal and the reset signal portion may conveniently be applied to each column conductor consecutively in an interval between successive data signals applied to the column conductor.

According to another aspect of the present invention, there is provided a matrix display device having a row and column and array of display elements comprising electrodes carried on facing surfaces of two supporting plates with an electro-optical display medium therebetween, sets of row and column conductors, each display element being connected in series with a non-linear switching device between associated row and column conductors, and row driver and column driver circuits for providing during respective row address periods a selection signal to each row conductor and data signals to the column conductors for a part of the address period by means of which signals a range of operational voltages can be produced at display elements for display purposes, the column driver circuit being arranged to provide a reference potential during the remainder of the address period, which is characterised in that the row driver circuit is arranged to start a row selection signal in a row address period a predetermined time before the beginning of the data signal provided by the column driver circuit and during the application of the reference potential to the column conductors, the reference potential provided by the column driver circuit being operable to charge the display elements of the row are charged towards the lower end of their operational voltage range prior to the application of the data signal.

BRIEF DESCRIPTION OF THE DRAWING

Methods of driving a matrix display device, and a matrix display device, particularly a liquid crystal display device, operable by such a method, in accordance with the invention will now be described, by way of example, with reference to the accompanying drawing figures in which.

It should be understood that the Figures are merely schematic and are not drawn to scale. It should also be understood that the same reference numerals are used throughout the Figures to indicate the same or similar parts.

DESCRIPTION OF THE PREFERRED EMBODIMENT

Figure 1:
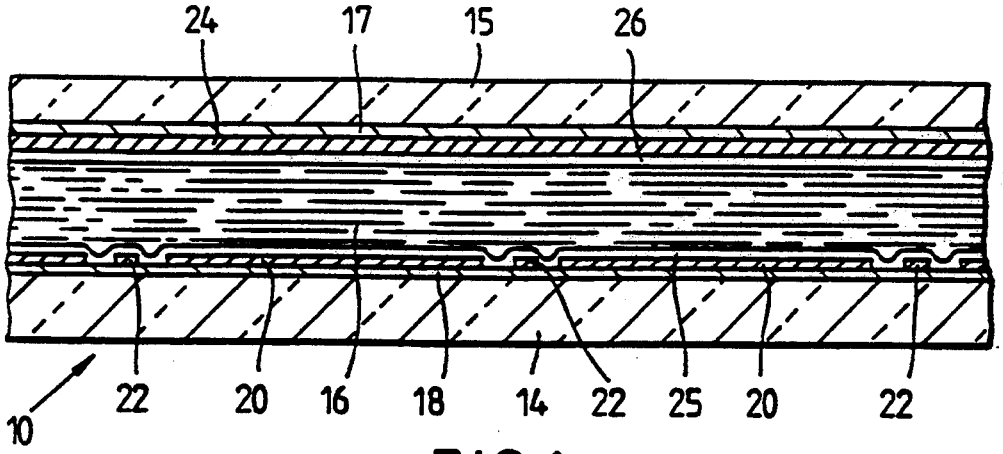
FIG. 1 is a schematic cross-section through a part of the liquid crystal display device showing a few display elements.
Figure 2:
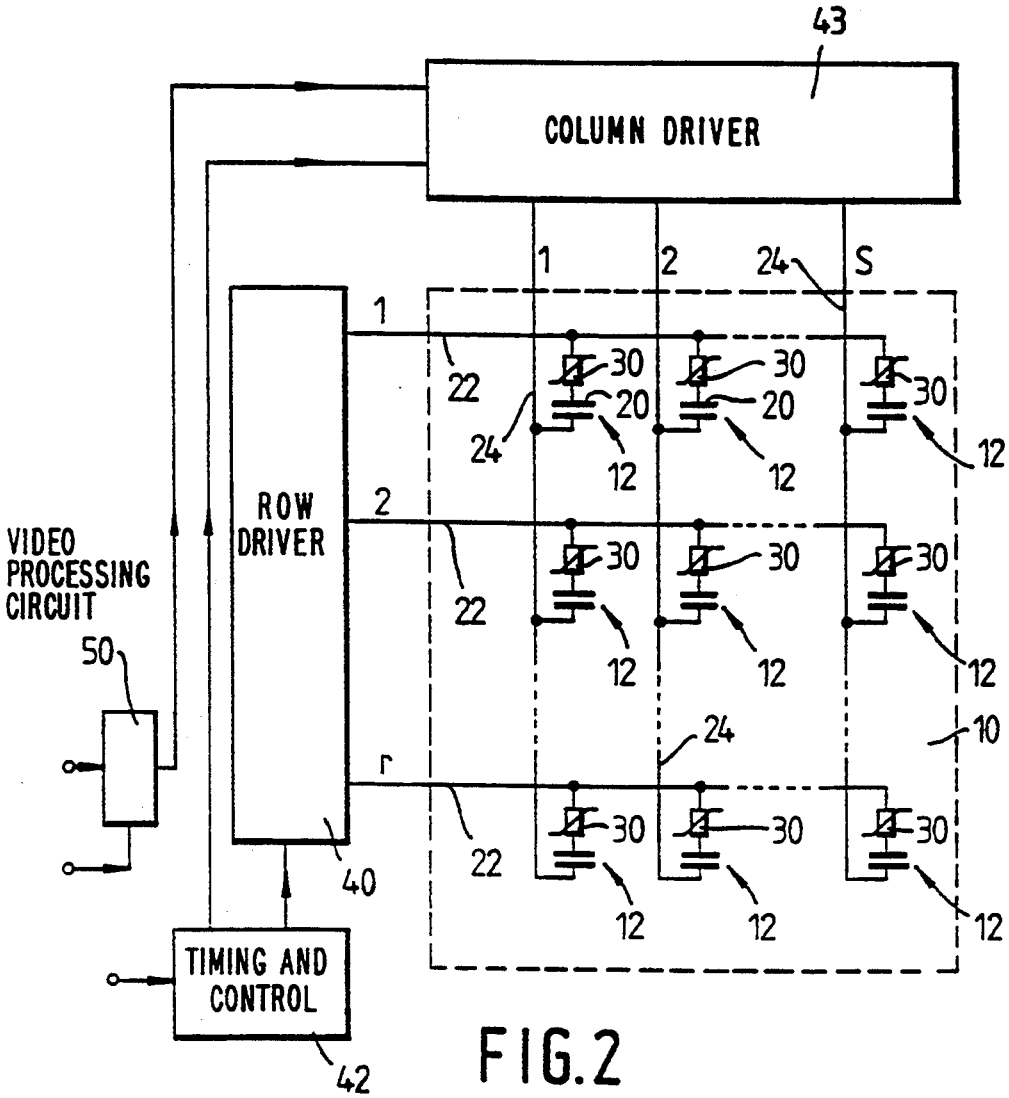
FIG. 2 is a simplified block diagram of the display device.

Referring to FIGS. 1 and 2, the display device, which is intended to display video, for example TV, pictures, includes an active matrix liquid crystal display panel 10 consisting of r rows (1 to r) with s display elements 12 (1 to s) in each row. Only a few display elements are depicted in FIG. 2 and in practice the total number of display elements (rxs) may be several hundreds of thousands. The panel 10, which operates in transmissive mode, comprises two spaced, transparent and insulating supporting plates 14 and 15, for example of glass, with twisted nematic liquid crystal material 16 disposed therebetween. The facing surfaces of the two plates 14 and 15 are covered with electrically and chemically insulating layers 17 and 18. In accordance with standard practice, the outer surfaces of the plates are provided with polarising layers (not shown). The plate 14 carries a row and column array of generally rectangular display element electrodes 20 of transparent conductive material and a set of row conductors 22 which, apart from the first, extend between adjacent pairs of display element rows. Each display element electrode 20 in a row is connected to an associated one of the row conductors through a bidirectional, non-linear resistance device 30 (not visible in FIG. 1) exhibiting a substantially symmetric threshold characteristic and functioning in operation as a switch, which in this example comprises a MIM.

The plate 15 carries a set of strip-shape column conductors 24 of transparent conductive material, each of which extends over a respective column of display element electrodes 20. At least where they overlie the electrodes 20 the conductors 24 are of similar width to the electrodes and these portions constitute opposing display element electrodes. Each display element 12 thus consists of two spaced electrodes between which liquid crystal material is disposed and is connected electrically in series with a MIM between associated row and column conductors. In an alternative configuration, the MIMs may be connected between the display elements and the column conductors.

The exposed surfaces of the layers on the two plates 14 and 15 are covered by LC orientation layers 25 and 26 in known manner.

In common with known display devices, the row conductors 22 serve as scanning electrodes and are controlled by a row driver circuit 40 which applies a selection signal to each row conductor 22 sequentially in turn during a respective row address period. In synchronism with the selection signals, achieved by means of the timing and control circuit 42, data signals are applied to the column conductors 24 from a column driver circuit 43 connected to the output of a video processing circuit 50 to produce a display effect from the rows of display elements 12 associated with the row conductors 22 as they are scanned. These data signals comprise video information and are obtained by sampling a TV line with serial to parallel conversion. As a result of the application of the selection and data signal voltages, the optical transmissivity of the display elements 12 of a row are controlled to produce the required visible display effect. The individual display effects of the display elements 12, addressed one row at a time, combine to build up a complete picture in one field, the display elements being addressed again in a subsequent field.

Figure 3:
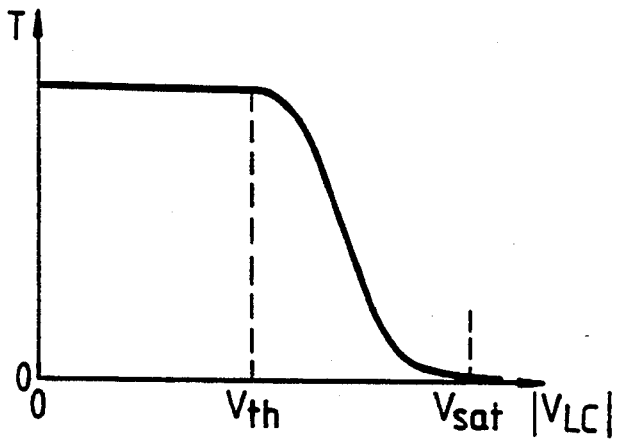
FIG. 3 illustrates graphically the transmission/voltage characteristic of a typical display element of the display device.

The transmission (T)/voltage (VLC) characteristic of a typical display element is depicted graphically in FIG. 3. In this case it is assumed that crossed polarisers are used. Below a certain threshold voltage, Vth, the maximum transmission occurs giving a peak white output, whereas beyond a saturation voltage, Vsat, transmission is substantially at a minimum, corresponding to a black output. The intermediate range (Vth to Vsat) constitutes the operational voltage range of the display element and forms the transition range allowing grey scale levels to be achieved. If parallel polarisers are used, the output effect is opposite with Vth and Vsat corresponding to minimum (black) and maximum (peak white) transmission respectively.

The voltage/conduction characteristic of the two-terminal non-linear devices 30 is bidirectional and substantially symmetrical with respect to zero voltage so that by reversing the polarity of the scanning and data signal voltages periodically a net dc bias across the display elements is avoided. Following known practice this inversion may be carried out after every line, every two lines or every field, commonly referred to as, respectively, line inversion, double line inversion and field inversion. Each time a display element is addressed, in successive fields, the polarity of the applied voltage is reversed.

Although the particular embodiment described employs MIMs, it will be appreciated that other forms of bidirectional non-linear switching devices exhibiting a threshold characteristic such as back-to-back diodes, diode rings, n-i-n or p-i-p diode structures etc., may be used instead.

Active matrix liquid crystal display devices employing two terminal non-linear devices as switching elements in series with the display elements are generally well known and for further information reference is invited to earlier publications describing such types of display devices, such as, for example, U.S. Pat. Nos. 4,223,308 and 4,642,620 using diode structures and U.S. Pat. Nos. 4,413,883 and 4,683,183, using MIMs.

Figure 4A:
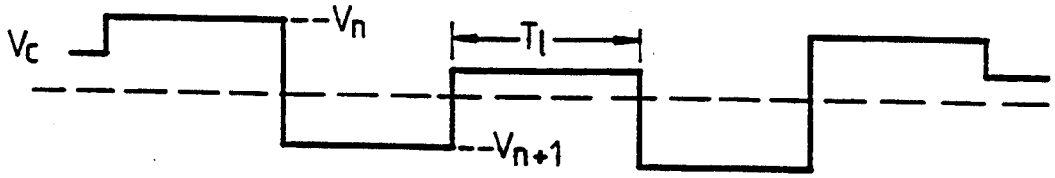
FIG. 4a PRIOR ART
FIGS. 4*a* and 4*b* show examples of waveforms applied to column and row conductors respectively in a known drive scheme.
Figure 4B:
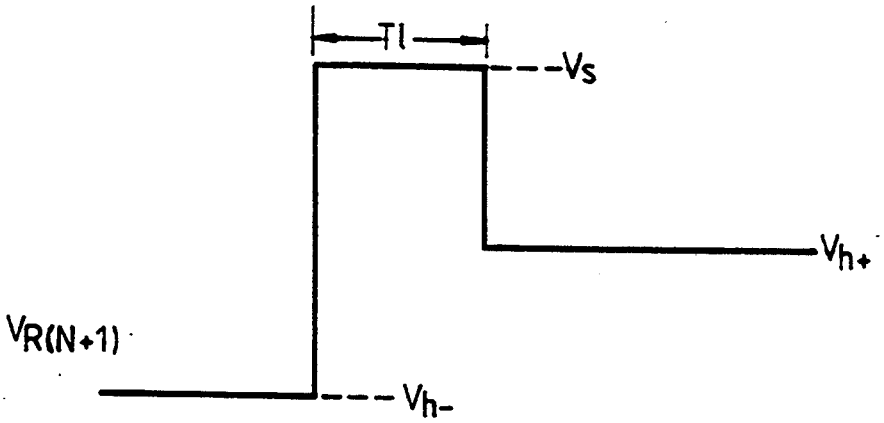

Row scanning in known display devices is conventionally accomplished using a waveform as depicted in FIG. 4*b* where the voltage $V_R$ of the (n+1)th row comprises a row selection signal portion of a duration corresponding to a TV line period Tl, e.g. 64 microseconds for a PAL system, and magnitude Vs followed immediately by a hold signal portion of lower, but similar polarity, voltage, Vh, for the remainder of the field period. In this example, the device is driven with field inversion so that the hold and select signal portions alternate between Vh+ and Vh− and Vs+ and Vs− respectively. The voltage waveform applied to a column conductor, Vc, is depicted in FIG. 4*a* and comprises data signals for a display element in each row, (Vn, Vn+1, etc.), each data signal having a duration substantially corresponding to the selection signal, i.e. a TV line period.

In order to reduce vertical cross talk problems, an alternative scheme has been proposed in U.S. Pat. No. 4,892,389, whose disclosure is incorporated herein by reference. An example of this alternative scheme is depicted by the waveforms in solid lines in FIGS. 5*a* and 5*b* which respectively show typical column and row conductor waveforms, and their relative timing, present using the line inversion drive approach. In this scheme, the length of time for which a data signal representing video information is present on the column conductors is reduced from the whole line period, Tl, (Tl =A+B in FIG. 5*a*) to a fraction F of the line time, i.e. F.Tl (=B). For the remainder of the line time, indicated at A and of duration (1−F).T1, the column conductor voltage is returned to a constant reference voltage level Vo so that the waveform comprises a succession of data signals separated by periods of the constant reference potential. The reference level Vo remains constant for successive fields. A single row address period is constituted by the duration of the reference potential part indicated at A together with the duration of the subsequent data signal indicated at B so that in one row address period, Tl, the parts A and B are applied to the column conductor. At the same time, the row selection signal, shown in solid lines FIG. 5*b*, is shortened such that it is no greater than F.Tl. This has the effect of reducing the vertical cross-talk by a factor F so that the acceptable ratio of switching device to display element capacitance is increased by the same factor. However, the reduction of the row selection signal time means that the display element capacitance must be charged in a shorter time and to achieve this a larger selection signal voltage (Vs) is required. This results in an increase in the peak current density in the switching device and can have serious consequences as damage or destruction of the switching devices may then occur.

With the method of the present invention the drive waveforms are modified so as to achieve display element charging in the shorter time required for cross-talk reduction whilst at the same time maintaining a comparatively low peak current density in the non-linear switching devices during operation. A part of the available row address period, corresponding to a TV line time, is used to charge the display elements in the row to an initial level and in a further, small, period the video information is in effect added to provide the required display effect output, e.g. the appropriate grey scale. Using shortened data signals provides improved cross-talk performance in similar manner as in the above scheme. In addition a reduction in peak current density in the switching devices is obtained.

To this end, the row driver circuit 40 is operable to provide signal waveforms to the row conductors 22 in which the leading edge of a row selection signal pulse occurs before the beginning of the associated data signal applied to the column conductor 24 and while a reference potential is being applied during the row address period. In a simple scheme, and referring to FIG. 5*a*, the selection signal period applied to the row in which a display element is to provide a display according to the data signal level Vn+1 is thus initiated during the period indicated at A in which the column conductor is at the reference potential Vo. The leading edge of the selection signal depicted in FIG. 5*b* is therefore shifted to the left in the Figure as shown by the dotted lines so that it precedes the leading edge of the data signal (Vn+1), the falling edge of this pulse staying as before, substantially coincident with termination of the data signal.

As a consequence of this shifting of the leading edge, the display element concerned during the row address period Tl is initially partially charged according to the level Vo in the period A and subsequently finally charged to the required value according to the level of the data signal, Vn+1, when this signal is applied to the column conductor during the period B.

Figure 5A:
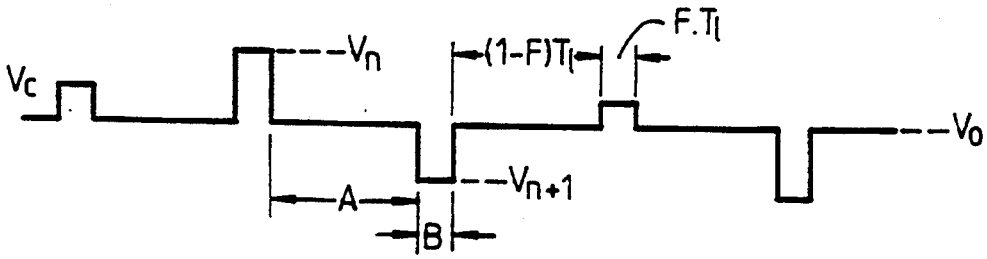
FIGS. 5*a* and 5*b* shows examples of waveforms applied to column and row conductors respectively in another known drive scheme and a modified drive scheme according to one embodiment of the present invention.
Figure 5B:
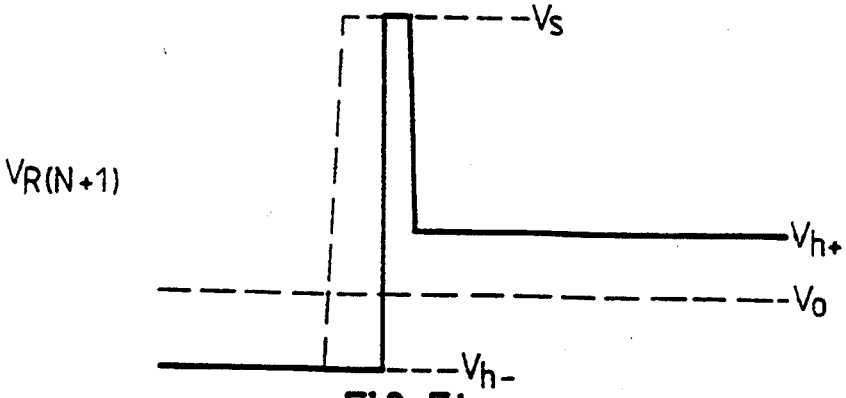

In this simple modified drive scheme illustrated in Figure 5*a* and 5*b* the pre-charging of the display elements is towards the constant level, Vo, of the reference potential. The level Vo is determined in the known scheme having regard to the cross-talk reduction requirement and corresponds to a mid-grey video level which is equivalent to a data signal level lying at the mid-point of the signal range applied to the column conductor. As a result then of the initial charging of the display element during period A the display element is charged towards, and assuming the pre-charging period is adequately long, substantially reaches the level of the lower end (white) of the display element's operational voltage range. In this embodiment, and referring to FIG. 3, this level corresponds with the threshold level, Vth, and thus the lower end of the display element transition range in the transmission/voltage characteristic of the liquid crystal material. If the level of the data signal following this precharging corresponds to a larger display element voltage then there is no difficulty and the charge on the display element is increased to the required value. However, if the level of the following data signal corresponds to a lower display element voltage, the display element is not discharged back to this level because the change in the signal on the column conductor (to a lower value) turns the non-linear device 30 off. The result of this is a transfer characteristic for video drive to display element voltage of the form illustrated graphically in FIG. 6, in which column voltage, Vc, is plotted against display element voltage, VLC. With a conventional drive scheme (FIG. 4), the relationship is as shown by the solid line and extends over the full range of operating voltage of the display element from Vth (peak white) to Vsat (black). With the above, modified, scheme the relationship changes to that shown by the dotted line from which it will be seen almost half the required display element voltage range is inaccessible.

Figure 7A:
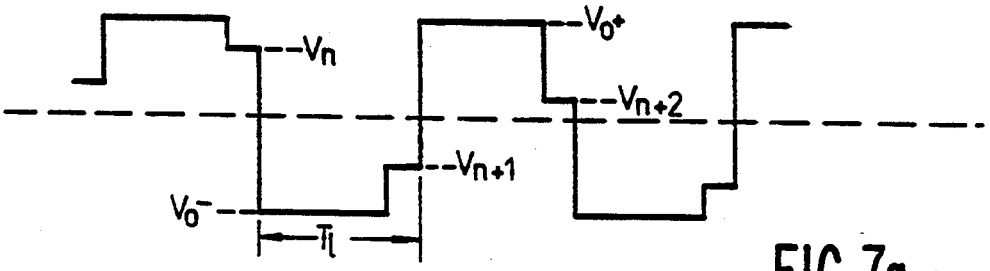
FIGS. 7*a*, and 7*c* illustrate column conductor waveforms used in a second embodiment of the present invention for alternative modes of operation.
Figure 7B:
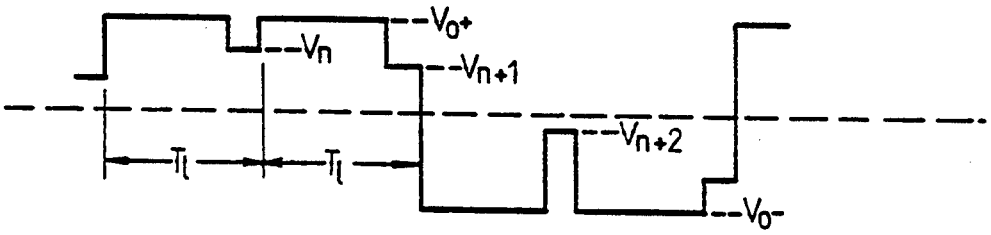
Figure 7C:
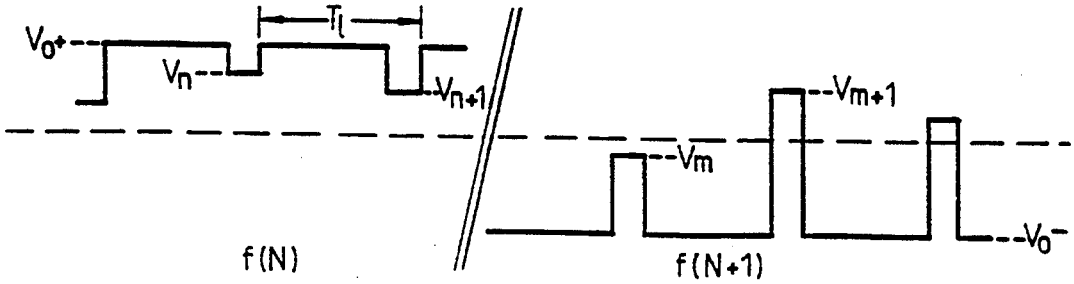

The simple modified drive scheme can be used to advantage to provide improved performance and reliability in some display applications. However, for many display applications, such as TV displays for example where a full range of grey scale is needed, this limitation is not acceptable. For this reason, in a preferred embodiment certain further changes are incorporated to enhance performance. More particularly the drive waveforms applied to the column conductors are also modified, by suitable adaptation of the column driver circuit 43. Examples of the modified column waveforms are shown in FIGS. 7*a, b* and *c* which illustrate forms present when utilising respectively line inversion, double line inversion, and field inversion drive schemes. Instead of returning the column voltage to a single, constant, level, (Vo), for the period (I-F). Tl when a data signal is not present, the reference potential is changed periodically between two levels, Vo+ and Vo−. For a line inversion drive scheme, FIG. 7*a*, in which the row conductor waveforms and data signals reverse sign every TV line, the reference level changes every TV line. For a double line inversion scheme, FIG. 7*b*, in which the row conductor waveforms and data signals reverse sign every two lines, the reference level similarly changes every two lines. For a field inversion drive scheme, FIG. 7*c*, in which the row conductor waveforms and data signals reverse sign every field, f, the reference level changes every field, f(N) and f(N+1) being successive field periods. The two levels of the column reference voltage, Vo+ and Vo−, correspond to the levels of data signals which, in combination with selection signals, would produce the smallest voltage in the range of operating voltages across the display element, i.e. Vth. In a display device using crossed polarisers, this level corresponds to peak white display while for parallel polarisers it corresponds to a black display.

Figure 6:
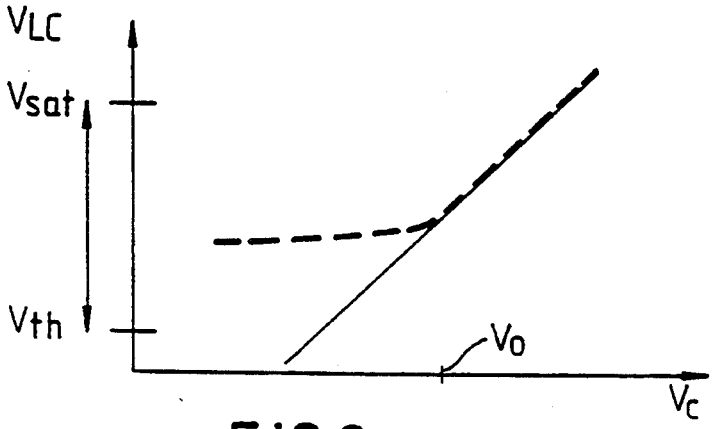
FIG. 6 illustrates graphically a relationship between a display element voltage and data signal level for the modified device scheme of FIGS. 5*a* and 5*b*.
Figure 8A:
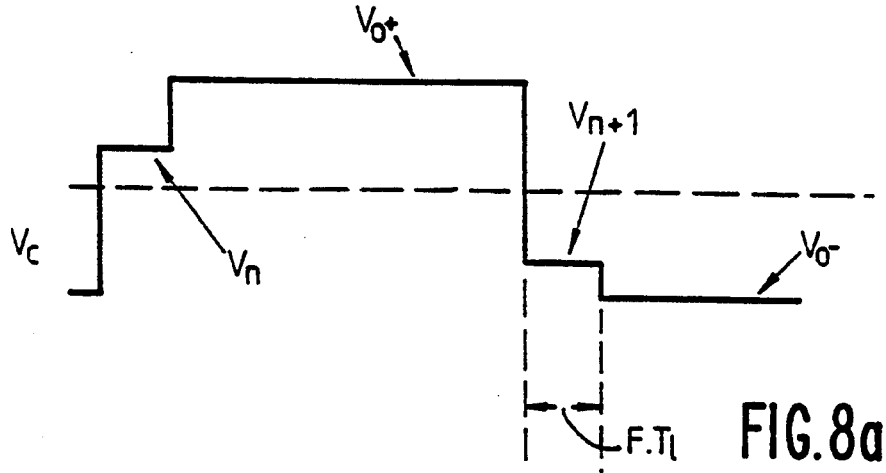
FIGS. 8*a* and 8*b* are waveforms showing the relative timing of row and column conductor signals used in the second embodiment of the present invention.
Figure 8B:
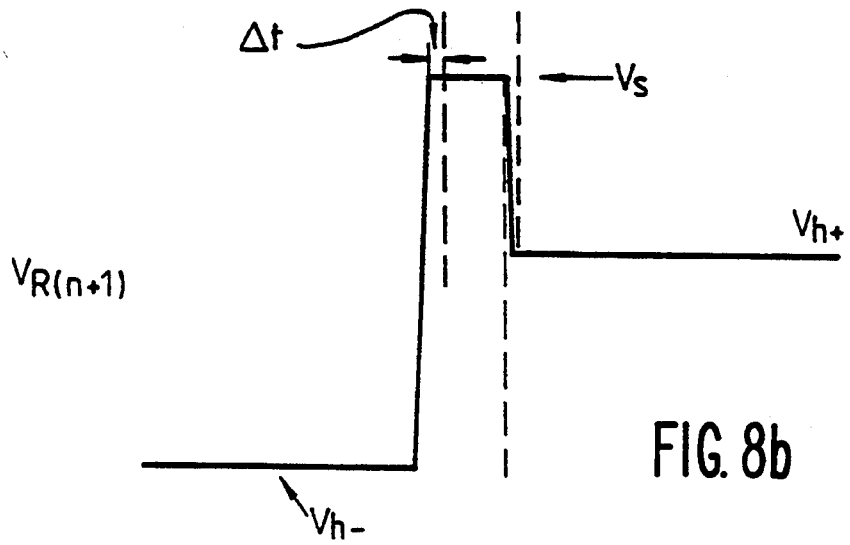

In addition, and as in the previous embodiment, the timing of the row selection signal pulse is determined relative to the data signal so that its rising edge is at least substantially complete before the column voltage changes from the reference level to the data signal level. Referring to FIGS. 8*a* and 8*b*, which illustrate the timing relationship between an example of a column waveform, (FIG. 8*a*), and a row conductor waveform, (FIG. 8*b*), in a line inversion scheme, the rise of the row selection pulse signal therefore commences a time Δt before the transition on the column conductor. During this period Δt the display element is charged towards the lowest end of its operating voltage range, Vth, as determined by the level Vo+, and the peak voltage across the non-linear switching device, and hence its peak current density, is minimised. The remainder of the display element charging towards the required display element voltage continues after the period Δt when the column voltage is switched to the video (data) level. Vertical cross-talk reduction is achieved as in the known scheme because the varying data (video) voltage is only present on the column conductors for the fraction, F, of the line time, Tl. Moreover, because the display element pre-charging is towards the lowest of the display element's operating voltage range the non-linearity in the relationship between column voltage and display element voltage illustrated in FIG. 6 is removed, or at least significantly reduced. Some residual non-linearity may remain if Δt is too large. Conversely, if Δt is made too small the current density in the non-linear device rises. The preferred useful range of Δt is, therefore, from a minimum approximately equal to the rise time of the row selection pulse signal to a maximum substantially equal to the width i.e. duration, of the data pulse signal, F.Tl.

As can be seen from FIGS. 8*a* and 8*b*, the row selection pulse signal is of such a duration that its trailing edge reaches the reference hold level, Vh+, slightly before, or substantially coincident with but not later than, the change in the column voltage from the data signal to the reference potential Vo−. To this end, termination of the selection signal is commenced a short time before the change in column voltage to allow for the finite fall time of the signal, as shown by the sloping trailing edge.

Figure 9:
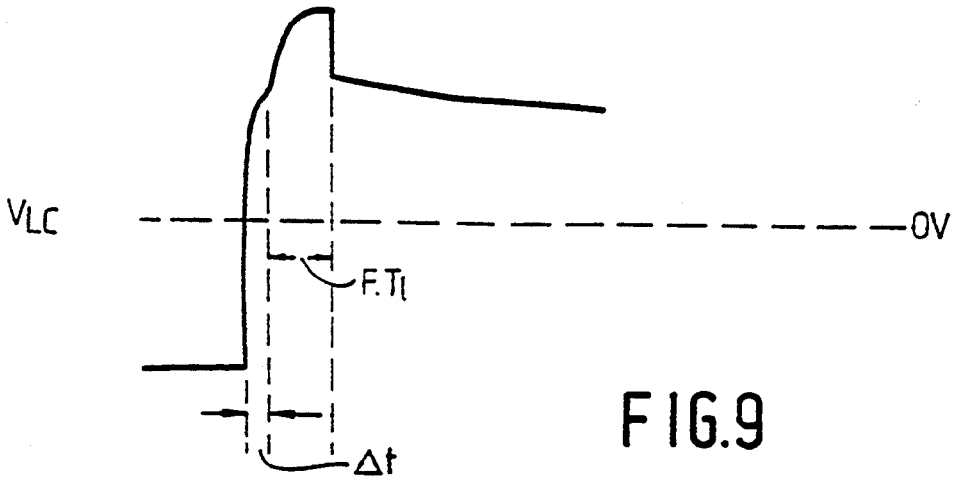
FIG. 9 shows the display element voltage for the case illustrated in FIGS. 8*a* and 8*b;*

The voltage appearing at the display element during the row address period as a result of the application of the waveforms shown in FIGS. 8*a* and 8*b* is illustrated in FIG. 9. The display element voltage increases during the period Δt and reaches an initial level according to the level Vo+. Thereafter, during the period F.Tl it is further increased to a level determined by the level of the data signal, Vn+1, and then drops back at the termination of the data signal and selection signal, due to capacitive coupling via the capacitance of the non-linear device 30, to the required display level. The hold level, Vh+, of the row conductor waveform is applied for the remainder of a field period, until the row concerned is next addressed. The hold level is approximately equal to the mean of the rms saturation and threshold voltages of the display elements, that is, $$Vh=(Vsat+Vth)/2.$$

This level is chosen to minimise the voltage appearing across the non-linear device during this time and maintain the device in the off condition so that the display element voltage is retained until it is driven again in the subsequent field period. However, due to the fact that the liquid crystal material has a finite resistance, some charge leakage will occur and consequently the display element voltage decays slightly. To counter the possible effects of this decay, the hold voltage level may be varied over the field period, rather than held constant, as is described in EP-A-0320054.

Figure 10A:
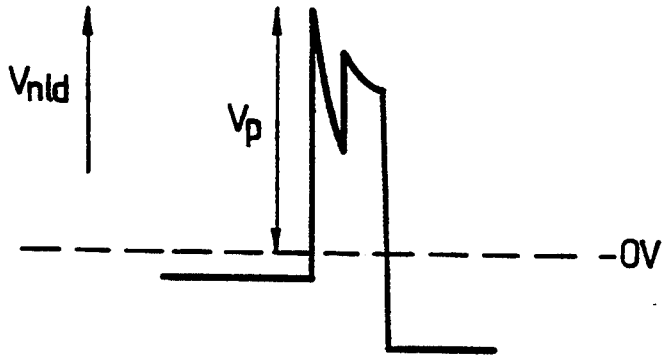
FIGS. 10*a* and 10*b* illustrate for comparison the voltages appearing across a typical non-linear switching device of the display device during operation using respectively a known drive scheme and the method according to the second embodiment of the present invention.
Figure 10B:
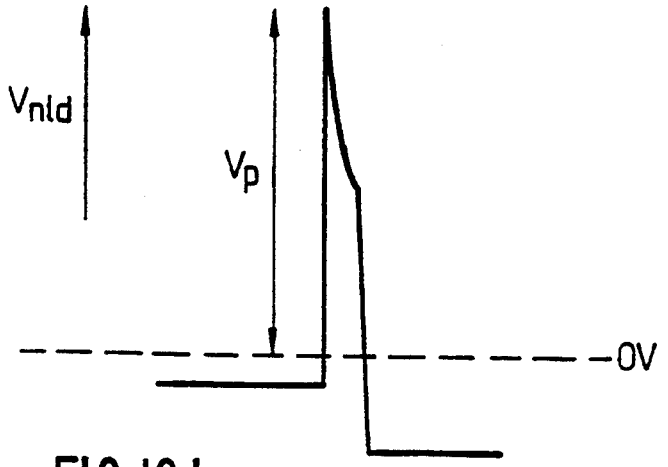

FIG. 10*a* shows the voltage appearing across the non-linear device 30, Vnld, during a row address period for a display element which is charged to its highest level. For comparison, FIG. 10*b* shows the voltage of a non-linear device in similar circumstances in the case of a display device operating with the known cross-talk reduction drive scheme. As can be seen, the peak voltage, Vp, of the non-linear device is significantly lower when using the drive scheme according to the present invention. Accordingly the probability of non-linear device failure is considerably reduced.

In the above described embodiment, the drive scheme involves a row signal waveform having four levels, consisting of selection signal and hold signal portions whose polarity is periodically inverted. The invention is applicable also to drive schemes of a kind in which the row signal waveforms in addition to selection signals similar to those in the four level drive scheme also include an additional selection signal in the form of a reset signal which is applied to a row address conductor followed immediately a setting signal, serving as another selection signal, for the row of display elements which in conjunction with display data signals, which are presented for a part only of the row address period, establishes the desired display element voltages to produce the required display effect from the display elements. Such a drive scheme is described in EP-A-0362939 to which reference is invited for further information and whose disclosure is incorporated herein by reference. Briefly, the purpose of the reset selection signals, which are applied to a row of display elements during the row address period associated with the preceding row of display elements, is to correct for non-uniformities in the behaviour of MIMs across the display device. Prior to presenting a setting signal which together with data signals provides the display elements of a row with a display element voltages of a certain voltage sign, the display elements are charged or discharged by means of the reset selection signal to an auxiliary voltage of the same voltage sign, this auxiliary voltage lying beyond or on the limit of the range used for picture display. The row signal waveform in this type of drive scheme consists then of five levels.

Figure 11:
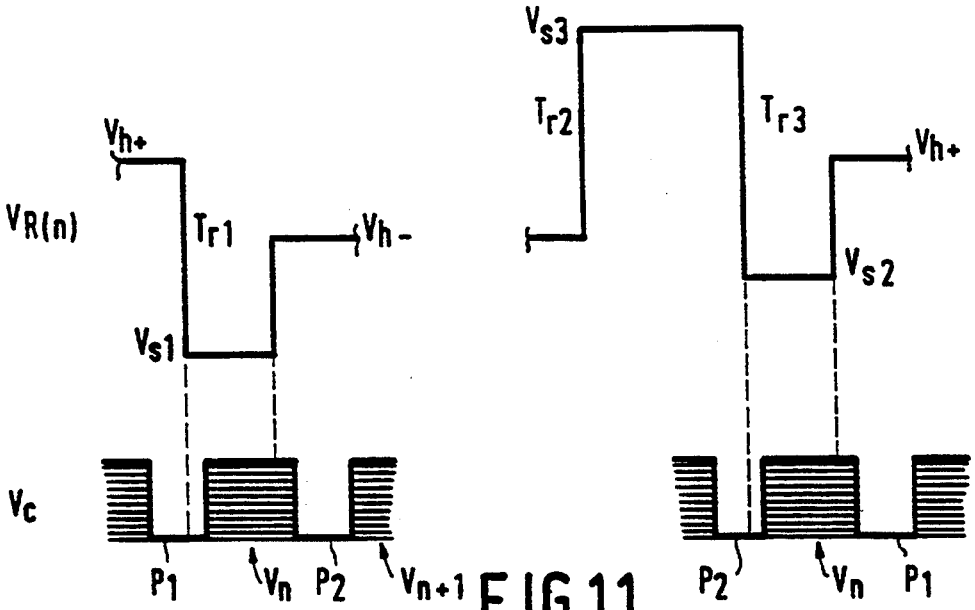
FIGS. 11 and 12 illustrate typical row and column conductor signal waveforms in a further embodiment according to the present invention using an alternative drive scheme.

FIG. 11 illustrates portions of typical row and column signals waveforms $V_R$ and $V_C$ in an alternative embodiment of the invention using this kind of drive scheme and operating in a line inversion mode. Referring to FIG. 11, $Vs_1$ and $Vs_2$ are respectively selection and setting signals for the nth row conductor which together with data signals, Vn, applied to the column conductors determine the display state of the associated display elements, and $Vs_3$ is the reset selection signal applied immediately prior to the setting signal $Vs_2$ during an address period for the preceding row of display elements in which a selection signal $VS_1$ is applied to that preceding row. The signal $VS_3$ is effective to charge the display elements of the row to the black level or beyond whereas the signals $VS_1$ and $VS_2$ set the display elements to the required display condition according to the data signal levels. The row signal waveform comprises three transitions, indicated at Tr1, Tr2 and Tr3 which could result in a high peak MIM current. The row and column signal waveforms are controlled in relation to one another in a manner similar to that of the previous embodiment such that the row selection signal commences before the data signal and while a reference potential, constituting a pre-charge voltage level for the display elements, is applied to the column conductors. The data signal Vn, whose level is in a range of possible values, as denoted by the horizontal lines, determining the display element's output, begins after the transition Tr1 of the selection signal Vs1. With regard to the selection signal $VS_1$ the manner in which this drive scheme operates corresponds to that for the selection signals (Vs) in the previous embodiment and effectively the same results are achieved. During the transition Tr1 a pre-charge reference level, P1, equivalent to the white level for this inversion polarity, is present on the column conductor in an interval between successive data signals. Similarly, in the succeeding field the data signal begins after the transition Tr3 with a pre-charge reference level, P2, equivalent to the black level for this inversion polarity being applied during this transition Tr3 in an interval between successive data signals. The reference levels P1 and P2 thus serve to reduce the peak current through the MIMs for two of the three transitions, Trl and Tr3, in the row signal waveform. In the illustrated example, the levels P1 and P2 are equal and correspond to a white signal level for a display element being addressed by a negative selection signals, Vs1, and a black signal level for a display element being addressed by a combination of a reset selection signal Vs3 and positive selection signal Vs2. Although in this particular embodiment the levels of P1 and P2 with often be the same, this need not necessarily always be the case and in certain situations the levels P1 and P2 can be different to one another.

Figure 12:
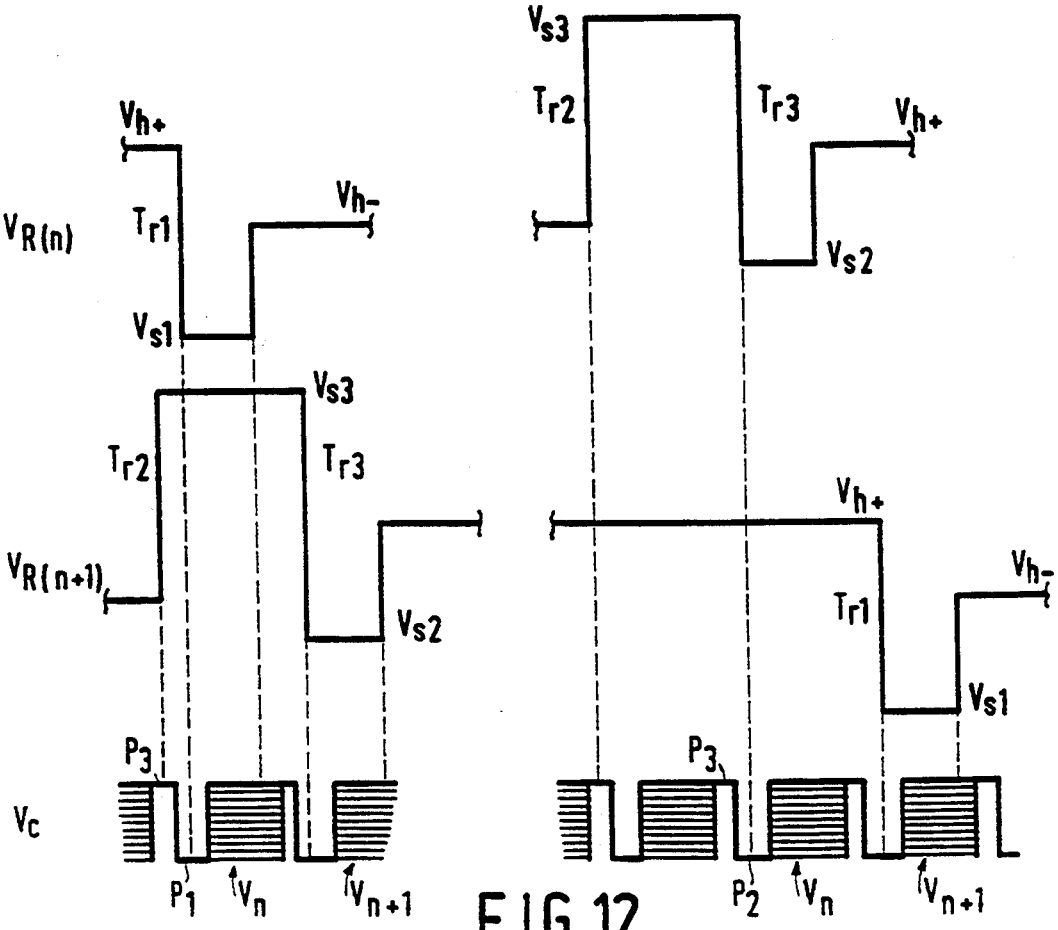

A reduction in peak current through the MIMs for all three transitions, Tr1, Tr2 alnd Tr3, can be obtained using the modified drive scheme illustrated in FIG. 12. FIG. 12 shows portions of the row signals, $V_R$ for the n and n+1 row conductors and portion of a typical column conduction signal Vc containing data signals, Vn and Vn+1, for display elements in these rows. As can be seen, the selection signals $V_{S1}$ and $V_{S2}$ are of slightly shorter duration than the reset signal $V_{S3}$ and the selection signal $V_{S1}$ for row n in the type of drive scheme using a five level row signal waveform is applied during the interval the reset selection signal $V_{S3}$ is applied to the succeeding n+1 row conductor and such that the selection signal $V_{S1}$ occurs after the transition Tr2 and before the transition Tr3 of the reset selection signal. In order then to reduce peak current through the MIMs during the transitions Tr2, the period between successive data signals, e.g. Vn and Vn+1, applied to a column conductor is divided into two parts during which respective and successive pre-charge reference levels are applied. The reference levels P1 and P2 correspond to those described previously and would usually be equal in value. The reference level, P3, applied immediately prior to those levels P1 and P2 coincides with the transitions Tr2 and corresponds to a signal level which is at or near the opposite end of the data signal range to the level P1. The level P3 remains the same, although as before the levels P1 and P2 need not necessarily be equal to one another but could instead be different.

With regard to the drive schemes depicted in both FIG. 11 and FIG. 12 it should be noted that all polarities of the row and column signal waveforms can be inverted while retaining precisely the same basic operating principles.

The combination of pre-charging the display elements together with short selection times in accordance with the drive schemes described is highly effective in reducing cross-talk without increasing the probability of non-linear device failure. The drive schemes can allow a wider range of display element dimensions to be used as the technological limits on the size of the non-linear devices are relaxed.

Various modifications are possible to the above described embodiments as will be apparent to persons skilled in the art. For example, a sub-pixellation technique can be used in which rather than using a single electrode 20, a display element comprises a plurality of sub-elements, each defined by a respective electrode carried on the plate 14 which are individually connected to a row conductor 22 via a respective non-linear device.

While the invention has been described with reference particularly to a twisted nematic liquid crystal display device, it is envisaged that other electro-optical materials can be used. Moreover, while the invention is particularly beneficial in the case of MIMs being used in view of their tendency to become damaged as a result of relatively high current densities, the invention can be applied advantageously to display devices employing other forms of two terminal non-linear switching devices known in the art, such as diode rings, back-to-back diodes, n-i-n, p-i-p or p-i-n-i-p elements, assuming that their switching characteristics meet the requirements.

From reading the present disclosure, other modifications will be apparent to persons skilled in the art. Such modifications may involve other features which are already known in the field of matrix display devices and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

We claim:

1. A method of driving a matrix display device comprising an electro-optical display medium between two supporting plates, an array of display elements arranged in rows and columns with each display element being constituted by electrodes provided on the facing surfaces of the supporting plates, and sets of row and column conductors, each display element being connected in series with a two-terminal nonlinear switching device between associated ones of the row and column conductors, in which each row of display elements is selected during a respective row address period by a row selection signal applied to the respective row conductor and data signals are applied via the column conductors by means of which selection and data signals a range of operational voltages can be produced at the display elements for display purposes, and in which each of the data signals is applied for only a part of the row address period, a reference potential being applied to the column conductors during the remainder of the row address period, characterised in that for a row of display elements the respective row selection signal commences prior to the application of the data signals and during the application of the reference potential, and has a duration which is longer than the duration of the data signals, whereby the display elements are initially charged to a level approaching the range of operational voltages and thereafter are charged to the required level according to the applied data signals.

2. A method according to claim 1, characterised in that in response to the selection signal the display elements are initially charged to a level approaching the lower end of the range of transition in the transmission/voltage characteristic of the electro-optical display medium.

3. A method according to claim 1 or 2, characterised in that the reference potential is periodically switched between two levels in accordance with a periodic inversion of the selection and data signals.

4. A method according to claim 1 or 2, characterised in that the leading edge of the selection signal is at least substantially complete before the voltage on a column conductor changes from the reference potential to the data signal.

5. A method according to claim 1 or 2, characterised in that the interval between the beginning of the selection signal and the beginning of the data signal is at least substantially equal to the rise time of the selection signal and at most substantially equal to the duration of the data signal.

6. A method according to claim 1 or 2, characterised in that the selection signal terminates before or coincident with the termination of the data signal.

7. A method according to claim 1, characterised in that the row signal waveform applied to each row conductor further includes a second selection signal comprising a reset signal portion by means of which the display elements of the row are charged at least to the upper end of the range of operational voltages followed by a setting signal portion by means of which the display elements are set at a level in the range of operational voltages according to the applied data signals, and in that for a row of display elements the setting signal portion commences prior to the application of the data signals and during the application of a reference potential whereby the display elements are charged from the level obtained by the reset signal portion back to a level close to the upper end of the range of operational voltages.

8. A method according to claim 7, characterised in that the reference potentials for use with the first-mentioned selection signal and the setting signal portion are applied to each column conductor in respective intervals between successive data signals applied to the column conductor.

9. A method according to claim 7 or 8, characterised in that for a row of display elements the reset signal portion commences prior to the application of the data signals to the column conductors intended for a preceding row of display elements and during the application of a further reference potential to the column conductors whereby the display elements of the row are charged to a level approaching the lower end of the range of operational voltage and thereafter are charged to at least the upper end of the said range.

10. A method according to claim 9, characterised in that the reference potentials for use with the first-mentioned selection signal and the reset signal portion are applied to each column conductor consecutively in an interval between successive data signals applied to the column conductor.

11. A method according to claim 7 or 8 characterised in that the first-mentioned selection signals and the second selection signals are applied to a row conductor alternately in successive field periods.

12. A method according to claim 7 or 8, characterised in that the setting signal portion terminates before or coincident with the termination of a data signal.

13. A method according to claim 1 or 2, characterised in that the electro-optical display medium comprises liquid crystal material.

14. A method according to claim 1 or 2, characterised in that the switching devices comprise MIMs.

15. A matrix display device having a row and column array of display elements comprising electrodes carried on facing surfaces of two supporting plates with an electro-optical display medium therebetween and sets of row and column conductors, each display element being connected in series with a non-linear switching device between associated ones of the row and column conductors, and row driver and column driver circuits for providing, during only a part of each respective row address period, a selection signal to each row conductor and data signals to the column conductors, said signals producing a range of operational voltages at display elements for display purposes, the column driver circuit being arranged to provide a reference potential during the remainder of each row address period, characterised in that the row driver circuit is arranged to start a row selection signal in a row address period a predetermined time before the beginning of the data signals provided by the column driver circuit and during the application of the reference potential to the column conductors, said row selection signal having a duration which is longer than the duration of said data signals, the reference potential provided by the column driver circuit being operable to charge the display elements of the row toward the range of operational voltages prior to the application of the data signals.

* * * * *